US006769151B1

(12) United States Patent
Lin

(10) Patent No.: US 6,769,151 B1
(45) Date of Patent: Aug. 3, 2004

(54) SCARIFYING AND DEBURRING TOOL

(76) Inventor: Yu-Ching Lin, 29, Lane 897, Min Shen South Road, Chia Yi City (TW)

( * ) Notice: Subject to any disclaimer, the term of this patent is extended or adjusted under 35 U.S.C. 154(b) by 0 days.

(21) Appl. No.: 10/389,756

(22) Filed: Mar. 18, 2003

(51) Int. Cl.[7] ..... A46B 9/023

(52) U.S. Cl. ..... 15/104.04; 15/104.095; 15/104.2; 15/106

(58) Field of Search ..... 15/104.03–104.05, 15/104.09, 104.095, 104.2, 106, 160, 164, 176.2, 176.3, 202

(56) References Cited

U.S. PATENT DOCUMENTS 1,710,127 A * 4/1929 Vaughn ..... 15/106
1,950,862 A * 3/1934 Page ..... 15/106
3,088,150 A * 5/1963 Sweeney ..... 15/106
3,188,674 A * 6/1965 Hobbs ..... 15/179
4,038,715 A 8/1977 Litt ..... 15/106
4,133,070 A 1/1979 Litt ..... 15/106
4,899,409 A * 2/1990 Cox, Jr. ..... 7/167
5,566,416 A * 10/1996 Karls ..... 15/104.04
5,791,005 A 8/1998 Grabowski et al. ..... 15/104.04

* cited by examiner

*Primary Examiner*—Mark Spisich
(74) *Attorney, Agent, or Firm*—Stites & Harbison, PLLC; Marvin Petry

(57) ABSTRACT

A scarifying and deburring tool includes a body, a handle mounted to the body, and a scarifying brush. The body has a fixing hole in an outer periphery thereof. A deburring scraper and a fixing block are mounted inside the body. The fixing block has a fixing hole in an outer periphery thereof. A fastener extends through the fixing hole of the body and the fixing hole of the fixing block. The fixing block further has a screw hole, and the scarifying brush has a threaded section for engaging with the screw hole of the fixing block. The scarifying brush can be replaced by a connecting rod for connection with an electric tool.

5 Claims, 3 Drawing Sheets

SCARIFYING AND DEBURRING TOOL

BACKGROUND OF THE INVENTION

1. Field of the Invention

The present invention relates to a scarifying and deburring tool for preparing an end portion of a cylindrically shaped member such as a section of tubing, pipe, or a fitting for soldering, brazing, welding or the like and, more particularly, to a scarifying and deburring tool suitable for scarifying inner and outer surfaces of end portions of cylindrically shaped members and deburring inner surfaces of end portions of cylindrically shaped members. In addition to scarifying the ends of pipe or tubing as hereinabove described, the subject hand tool may also be advantageously employed for many other purposes. For example, it may also be used to scarify battery terminals, battery cable ends and the like. Moreover, it may also be used in any environment where a generally cylindrical internal and/or external surface area is to be scarified.

2. Description of the Related Art

Scarifying and deburring tools for scarifying inner and outer surfaces of end portions of cylindrically shaped members and deburring inner surfaces of ends of pipe or tubing have been disclosed in, e.g., U.S. Pat. No. 4,038,715 to Litt, U.S. Pat. No. 4,133,070 to Litt, and U.S. Pat. No. 5,791,005 to Grabowski et al. These tools can only be used manually; namely, they cannot be used with electric tools, which is a limitation to the tools.

SUMMARY OF THE INVENTION

An object of the present invention is to provide a scarifying and deburring tool that can be either operated manually or activated by electricity.

In accordance with a first aspect of the invention, a scarifying and deburring tool includes a body, a handle mounted to the body, and a scarifying brush. The body has a fixing hole in an outer periphery thereof. A deburring scraper and a fixing block are mounted inside the body. The fixing block has a fixing hole in an outer periphery thereof. A fastener extends through the fixing hole of the body and the fixing hole of the fixing block. The fixing block further has a screw hole, and the scarifying brush has a threaded section for engaging with the screw hole of the fixing block.

In accordance with a second aspect of the invention, a scarifying and deburring tool includes a body, a handle mounted to the body, and a connecting rod. The body has a fixing hole in an outer periphery thereof. A deburring scraper and a fixing block are mounted inside the body. The fixing block has a fixing hole in an outer periphery thereof. A fastener extends through the fixing hole of the body and the fixing hole of the fixing block. The fixing block further has a screw hole, and the connecting rod has a threaded section for engaging with the screw hole of the fixing block.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
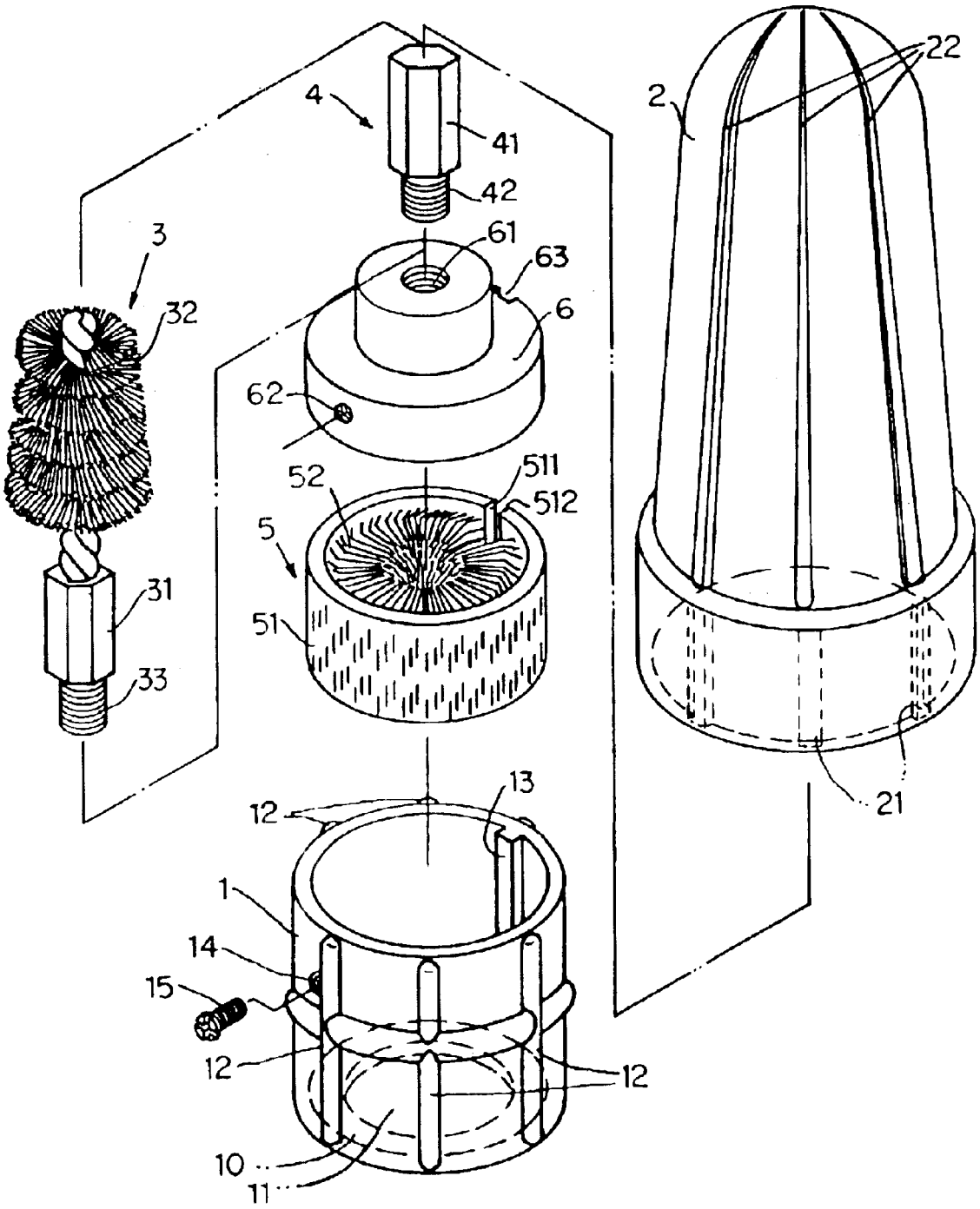
FIG. 1 is an exploded perspective view of a scarifying and deburring tool in accordance with the present invention.
Figure 2:
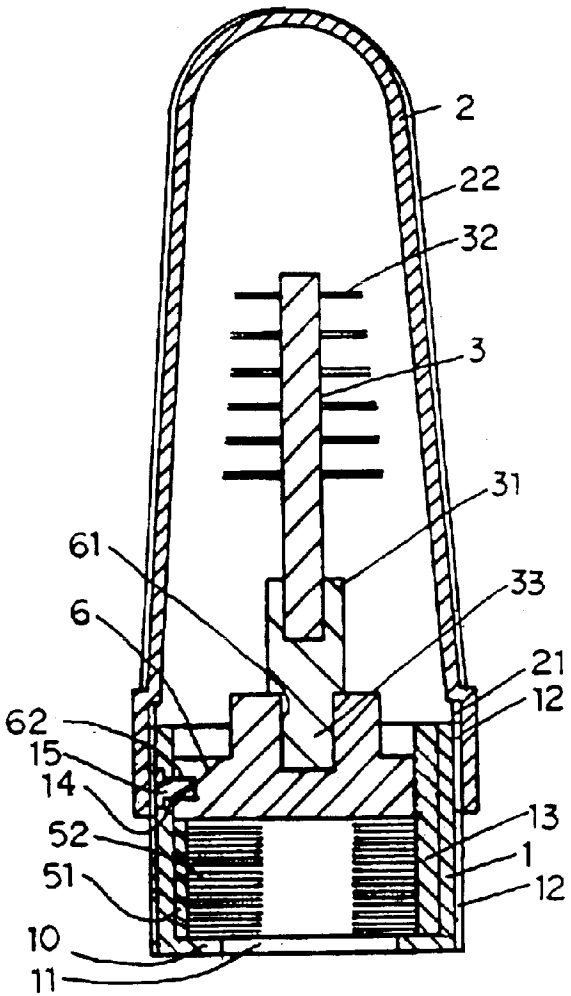
FIG. 2 is a sectional view of the scarifying and deburring tool in accordance with the present invention.

Referring to FIGS. 1 and 2, a scarifying and deburring tool in accordance with the present invention includes a body 1, a handle 2, and a scarifying brush 3. A deburring scraper 5 and a fixing block 6 are mounted in the body 1. The fixing block 6 has a screw hole 61 for connecting with the scarifying brush 3 or a connecting rod 4.

As illustrated in FIGS. 1 and 2, the body 1 is a substantially cylindrical member having an open upper end and a bottom wall 10 at a lower end thereof. A throughbore 11 is defined in a central portion of the bottom wall 10, and a plurality of tenons 12 are provided an outer periphery of the body 1. Further, a rib 13 is formed on an inner periphery of the body 1 and extends along a longitudinal direction of the body 1. Further, a fixing hole 14 is defined in the body 1 and extends in a radial direction, allowing a fastener 15 (e.g., a bolt or screw) to extend through the fixing hole 14.

The deburring scraper 5 is a substantially C-shaped member 51 made of bendable material such as rubber. A plurality of metal bristles 52 is fixed to the member 51 before bending, and the member 51 is then bent to form a substantially C-shaped member 51 having two opposed end faces 511 and 512, with the metal bristles 52 being fixedly located inside the C-shaped member 51. The member 51 before bending has a length slightly smaller than an inner diameter of the body 1. Thus, when the member 51, after bending, is inserted into the body 1, a bottom wall of the deburring scraper 5 and an outer periphery of the deburring scraper 5 are respectively in contact with the bottom wall 10 of the body 1 and the inner periphery of the body 1. Further, the end faces 511 and 512 of the C-shaped member 51 abut opposite sides of the rib 13.

The fixing block 6 is a substantially cylindrical member made of a rigid material such as plastics, aluminum, iron, etc. The fixing block 6 includes a screw hole 61 for connection with the scarifying brush 3 or the connecting rod 4. The fixing block 6 further has a fixing hole 62 and a groove 63 in an outer periphery thereof. The fixing hole 62 of the fixing block 6 is aligned with the fixing hole 14 of the body 1, and the groove 63 is aligned with the rib 13 of the body 1. Thus, when the fixing block 6 is mounted into the body 1 via the open end of the body 1, a bottom side of the fixing block 6 is in contact with an upper end of the deburring brush 5. The fastener 15 is extended through the fixing hole 62 of the fixing block 6 and the fixing hole 14 of the body 1, thereby securing the fixing block 6 and the deburring brush 5 inside the body 1.

The handle 2 is a substantially conic member having a closed upper end and an open lower end as illustrated in FIG. 1. Alternatively, the handle can be a substantially cylindrical member made of a rigid material such as plastics, aluminum, iron, etc. The handle 2 includes a plurality of mortises 21 defined in an inner periphery thereof. The mortises 21 are respectively engaged with the tenons 12 of the body 1 when the handle 2 is mounted to the body 1, allowing joint rotation of the body 1 and the handle 2 when the handle 2 is turned. A plurality of anti-slip strips 22 are provided on an outer periphery of the handle 2, preventing slippage while turning the handle 2.

Figure 3:
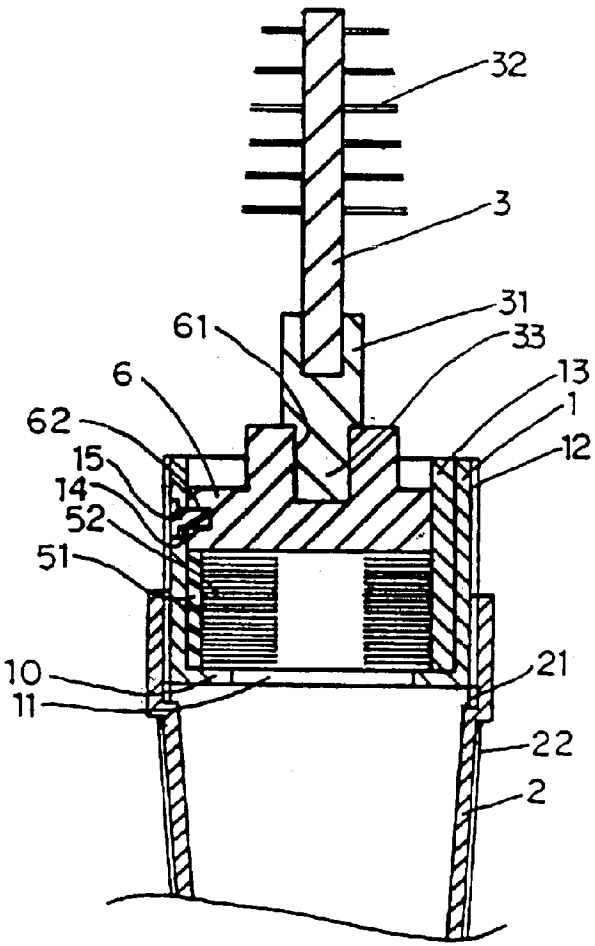
FIG. 3 is a sectional view of a first use of the scarifying and deburring tool in accordance with the present invention.
Figure 4:
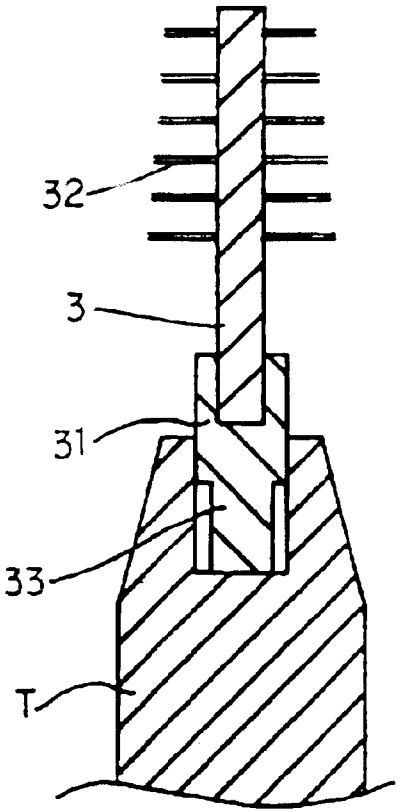
FIG. 4 is a sectional view illustrating use of a deburring scraper with an electric tool.

The scarifying brush 3 includes a polygonal rod 31 having a cylindrical or conic bristle section 32 on an end thereof. A threaded section 33 is formed on the other end of the polygonal rod 31 for engaging with the screw hole 61 of the fixing block 6, forming an easy-to-grasp brush, as illustrated in FIG. 3. Alternatively, the scaring brush 3 per se can be used with an electric tool T, as shown in FIG. 4.

Figure 5:
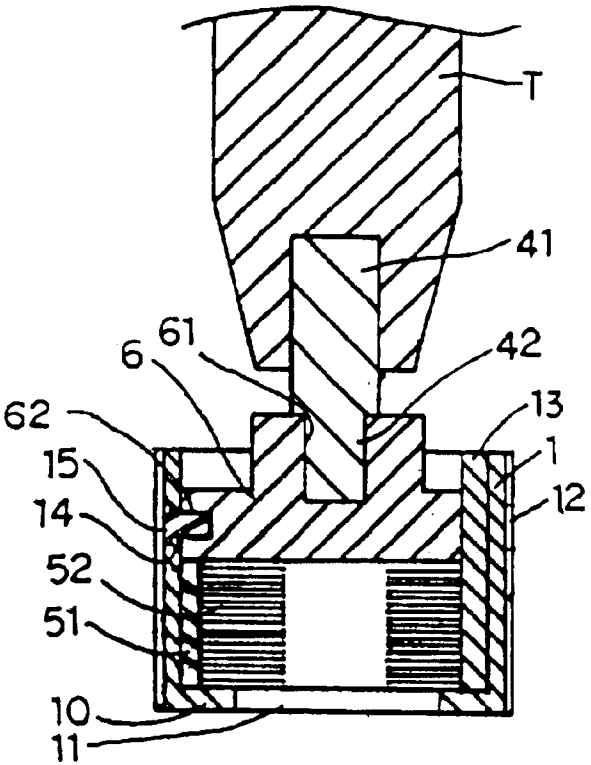
FIG. 5 is a sectional view illustrating use of a scarifying brush with an electric tool.

Referring to FIG. 5, the connecting rod 4 includes a polygonal shank 41 having a threaded section 42 on an end thereof for engaging with the screw hole 61 of the fixing block 6. The other end of the connecting rod 4 is connected to an electric tool T. Thus, the body 1 can be driven by the electric tool T.

It is noted that the subject hand tool may also be advantageously employed for many outer purposes. For example, it may also be used to scarify battery terminals, battery cable ends and the like. Moreover, it may also be used in any environment where a generally cylindrical internal and/or external surface area is to be scarified. An anode terminal or a cathode terminal of a battery or an end of a piping or tubing is inserted into the throughbore 11 of the bottom wall 10 of the body 1. When the body 1 is manually turned, the rusts on the surface of the terminal of the battery or the end surface of the piping or tubing are removed by the bristles 52 of the deburring scraper 5. Alternatively, the connecting rod 4 is used to connect the body 1 with an electric tool T, allowing rapid removal of the rusts on the surface of the terminal of the battery or the end surface of the piping or tubing by the electric tool T, as shown in FIG. 5.

The threaded section 33 of the scarifying brush 3 can be engaged with the screw hole 61 of the fixing block 6, forming a hand held tool, as shown in FIG. 3. Alternatively, as illustrated in FIG. 4, the threaded section 33 of the scarifying brush 3 can be engaged with an electric tool T for cleaning battery terminals or battery cable ends.

The deburring scraper 5 is fixed inside the body 1 by the fixing block 6, allowing easy removal of the fixing block 6 from the body 1 through removal of the fastener 15. Thus, the deburring scraper 5 can be easily replaced with a new one when desired. Further, replacement of the scarifying brush 3 can also be easily achieved owing to provision of the threaded section 33 of the scarifying brush 3 and the screw hole 61 of the fixing block 6.

Although the invention has been explained in relation to its preferred embodiment, it is to be understood that many other possible modifications and variations can be made without departing from the scope of the invention as hereinafter claimed.

What is claimed is:

1. A scarifying and deburring tool comprising:

a body having a fixing hole in an outer periphery thereof, a deburring scraper and a fixing block being mounted inside the body, the fixing block having a fixing hole in an outer periphery thereof, a fastener extending through the fixing hole of the body and the fixing hole of the fixing block, the fixing block further having a screw hole;

a handle mounted to the body; and a scarifying brush having a threaded section for engaging with the screw hole of the fixing block.

2. The scarifying and deburring tool as claimed in claim 1, wherein the fixing block has a groove in the outer periphery thereof, the body having a rib on an inner periphery thereof, with the rib of the body being engaged in the groove of the fixing block.

3. The scarifying and deburring tool as claimed in claim 1, wherein the handle includes a plurality of mortises defined in an inner periphery thereof, and wherein the body includes a plurality of tenons respectively engaged in the mortises of the handle.

4. The scarifying and deburring tool as claimed in claim 1, wherein the handle includes a plurality of anti-slip strips on an outer periphery thereof.

5. A scarifying and deburring tool comprising:

a body having a fixing hole in an outer periphery thereof, a deburring scraper and a fixing block being mounted inside the body, the fixing block having a fixing hole in an outer periphery thereof, a fastener extending through the fixing hole of the body and the fixing hole of the fixing block, the fixing block further having a screw hole;

a handle mounted to the body; and a connecting rod having a threaded section for engaging with the screw hole of the fixing block.

* * * * *